US007793514B2

(12) United States Patent
Rios et al.

(10) Patent No.: US 7,793,514 B2
(45) Date of Patent: Sep. 14, 2010

(54) METHOD AND SYSTEM FOR HORIZONTAL COIL CONDENSATE DISPOSAL

(75) Inventors: Arturo Rios, Avon, IN (US); Floyd J. Frenia, Brownsburg, IN (US); Jason M. Thomas, Morgantown, IN (US); Michael V. Hubbard, Pittsboro, IN (US); Thomas K. Rembold, Danville, IN (US)

(73) Assignee: Carrier Corporation, Farmington, CT (US)

( * ) Notice: Subject to any disclaimer, the term of this patent is extended or adjusted under 35 U.S.C. 154(b) by 347 days.

(21) Appl. No.: 11/337,106

(22) Filed: Jan. 20, 2006

(65) Prior Publication Data

US 2007/0169499 A1 Jul. 26, 2007

(51) Int. Cl.
*F25D 21/14* (2006.01)

(52) U.S. Cl. ..... 62/285; 62/291

(58) Field of Classification Search ..... 62/285, 62/273, 287, 288, 291, 290, 150, 272, 259.1; 220/571; 137/312, 313
See application file for complete search history.

(56) References Cited

U.S. PATENT DOCUMENTS

| | | | | | |
|---|---|---|---|---|---|
| 2,599,965 | A | | 6/1952 | Young | |
| 3,383,878 | A | * | 5/1968 | Booth | 62/281 |
| 3,823,770 | A | | 7/1974 | Duell et al. | |
| 3,831,670 | A | | 8/1974 | Mullings | |
| 4,000,779 | A | * | 1/1977 | Irwin | 165/111 |
| 4,083,198 | A | | 4/1978 | Dennis | |
| 4,129,013 | A | | 12/1978 | Hine, Jr. | |
| 4,474,232 | A | * | 10/1984 | Wright et al. | 165/137 |
| 4,597,269 | A | * | 7/1986 | Kim | 62/286 |
| 4,687,604 | A | * | 8/1987 | Goettl | 261/29 |
| 4,856,672 | A | * | 8/1989 | Sullivan | 220/571 |
| 4,905,474 | A | * | 3/1990 | Larinoff | 60/692 |
| 5,071,027 | A | * | 12/1991 | Sullivan | 220/571 |
| 5,105,630 | A | * | 4/1992 | Kim | 62/285 |
| 5,152,154 | A | | 10/1992 | Sullivan | |
| 5,207,074 | A | | 5/1993 | Cox et al. | |
| 5,613,554 | A | | 3/1997 | Bull et al. | |
| 5,664,431 | A | * | 9/1997 | Martin, Sr. | 62/286 |
| 5,715,697 | A | | 2/1998 | Rust, Jr. et al. | |
| 5,904,053 | A | | 5/1999 | Polk et al. | |
| 5,979,171 | A | * | 11/1999 | Mitchell et al. | 62/288 |
| 5,987,909 | A | | 11/1999 | Martin, Sr. | |
| 6,112,536 | A | * | 9/2000 | Hansen | 62/285 |
| 6,182,745 | B1 | | 2/2001 | Potier | |
| 6,276,443 | B1 | * | 8/2001 | Martin, Sr. | 165/126 |
| 6,360,911 | B1 | * | 3/2002 | Arnold | 220/571 |
| 6,405,552 | B1 | | 6/2002 | Hubert et al. | |
| 6,435,265 | B1 | | 8/2002 | Lakdawala et al. | |
| 6,591,627 | B1 | | 7/2003 | Rollins | |
| 6,729,152 | B2 | | 5/2004 | Gully et al. | |
| 6,895,770 | B1 | * | 5/2005 | Kaminski | 62/285 |
| 6,901,766 | B1 | | 6/2005 | Jin et al. | |
| 6,978,909 | B2 | | 12/2005 | Goetzinger et al. | |
| 7,263,850 | B2 | * | 9/2007 | Eom et al. | 62/286 |
| 2006/0112683 | A1 | * | 6/2006 | Huber | 60/324 |
| 2007/0169493 | A1 | | 7/2007 | Rios | |

* cited by examiner

*Primary Examiner*—Mohammad M Ali
(74) *Attorney, Agent, or Firm*—Cantor Colburn LLP

(57) ABSTRACT

Condensate formed on a horizontally oriented multi-poise evaporator coil is caught between a top coil slab and a bottom coil slab using a splitter, and is directed to a condensate pan located under the bottom coil slab, using at least one splash guard.

1 Claim, 7 Drawing Sheets

METHOD AND SYSTEM FOR HORIZONTAL COIL CONDENSATE DISPOSAL

CROSS-REFERENCE TO RELATED APPLICATION(S)

The following application is filed on the same day as the following co-pending applications: "CASING ASSEMBLY SUITABLE FOR USE IN A HEAT EXCHANGE ASSEMBLY" by inventors Floyd J. Frenia, Arturo Rios, Thomas K. Rembold, Michael V. Hubbard, Jason Michael Thomas, and Stephen R. Carlisle (application Ser. No. 11/336,278); "CONDENSATE PAN INSERT" by inventors Jason Michael Thomas, Floyd J. Frenia, Thomas K. Rembold, Arturo Rios, Michael V. Hubbard, and Dale R. Bennett (application Ser. No. 11/336,626); "METHOD AND SYSTEM FOR VERTICAL COIL CONDENSATE DISPOSAL" by inventors Thomas K. Rembold, Arturo Rios, Jason Michael Thomas, and Michael V. Hubbard (application Ser. No. 11/336,382); "CASING ASSEMBLY SUITABLE FOR USE IN A HEAT EXCHANGE ASSEMBLY" by inventors Arturo Rios, Thomas K. Rembold, Jason Michael Thomas, Stephen R. Carlisle, and Floyd J. Frenia (application Ser. No. 11/337,157); "LOW-SWEAT CONDENSATE PAN" by inventors Arturo Rios, Floyd J. Frenia, Thomas K. Rembold, Michael V. Hubbard, and Jason Michael Thomas (application Ser. No. 11/336,648); "CONDENSATE PAN INTERNAL CORNER DESIGN" by inventor Arturo Rios (application Ser. No. 11/337,107); "VERTICAL CONDENSATE PAN WITH NON-MODIFYING SLOPE ATTACHMENT TO HORIZONTAL PAN FOR MULTI-POISE FURNACE COILS" by inventor Arturo Rios (application Ser. No. 11/337,100); "CONDENSATE SHIELD WITH FASTENER-FREE ATTACHMENT FOR MULTI-POISE FURNACE COILS" by inventor Arturo Rios (application Ser. No. 11/336,381); and "SPLASH GUARD WITH FASTENER-FREE ATTACHMENT FOR MULTI-POISE FURNACE COILS" by inventor Arturo Rios (application Ser. No. 11/336,651), which are incorporated herein by reference.

BACKGROUND OF THE INVENTION

The present invention relates generally to a method and system for disposing of condensation formed on an evaporator coil. More particularly, the invention relates to a method and system for catching the condensation from a top coil slab of a multi-poise coil oriented horizontally, and directing the condensation to a condensate pan.

In a conventional refrigerant cycle, a compressor compresses a refrigerant and delivers the compressed refrigerant to a downstream condenser. From the condenser, the refrigerant passes through an expansion device, and subsequently, to an evaporator. The refrigerant from the evaporator is returned to the compressor. In a split system heating and/or cooling system, the condenser may be known as an outdoor heat exchanger and the evaporator as an indoor heat exchanger, when the system operates in a cooling mode. In a heating mode, their functions are reversed.

In the split system, the evaporator is typically a part of an evaporator assembly coupled with a furnace. However, some cooling systems are capable of operating independent of a furnace. A typical evaporator assembly includes an evaporator coil (e.g., a coil shaped like an "A", which is referred to as an "A-frame coil") and a condensate pan disposed within a casing. An A-frame coil is typically referred to as a "multi-poise" coil because it may be oriented either horizontally or vertically in the casing of the evaporator assembly. During a cooling mode operation, a furnace blower circulates air into the casing of the evaporator coil assembly, where the air cools as it passes over the evaporator coil. The blower then circulates the air to a space to be cooled.

Refrigerant is enclosed in piping that is used to form the evaporator coil. If the temperature of the evaporator coil surface is lower than the dew point of air passing over it, the evaporator coil removes moisture from the air. Specifically, as air passes over the evaporator coil, water vapor condenses on the evaporator coil. The condensate pan of the evaporator assembly collects the condensed water as it drips off of the evaporator coil. The collected condensation then typically drains out of the condensate pan through a drain hole in the condensate pan.

BRIEF SUMMARY OF THE INVENTION

Condensate formed on a horizontally oriented multi-poise evaporator coil is caught between a top coil slab and a bottom coil slab using a splitter, and is directed to a condensate pan located under the bottom coil slab, using at least one splash guard.

DETAILED DESCRIPTION

Figure 1A:
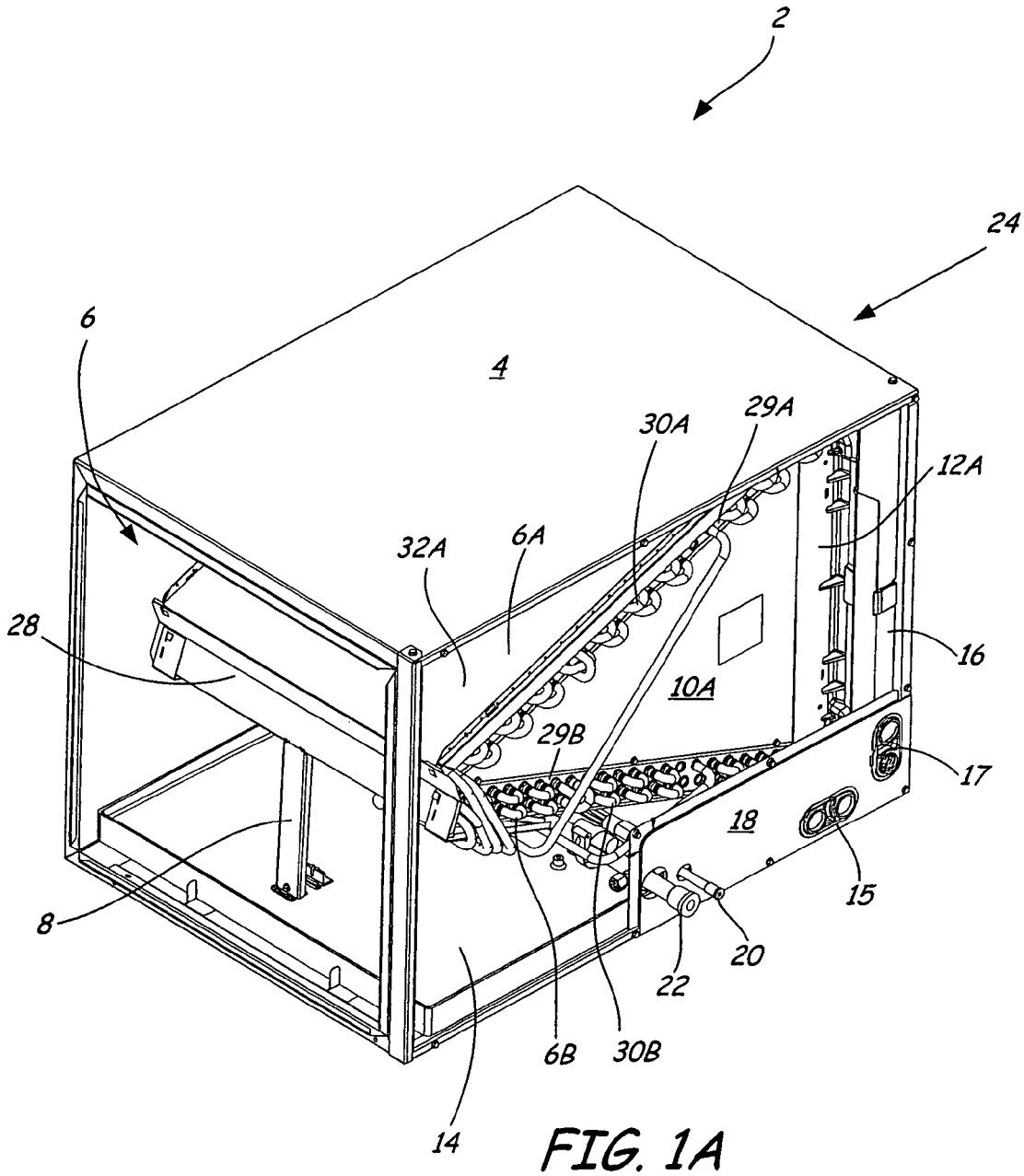
FIG. 1A is a perspective view of an evaporator assembly, which includes an evaporator coil, oriented horizontally, and a condensate pan disposed within a casing.

FIG. 1A is a perspective view of evaporator assembly 2, which includes casing 4, A-frame evaporator coil ("coil") 6, coil brace 8, first delta plate 10A second delta plate 12A, horizontal condensate pan 14, drain holes 15, vertical condensate pan 16, drain holes 17, first cover 18, input refrigerant line 20, and output refrigerant line 22. Coil 6 is a multi-poise A-frame coil, and may be oriented either horizontally or vertically. Evaporator assembly 2 is configured such that coil 6 may be used in either a horizontal or vertical configuration, which is why evaporator assembly 2 includes horizontal condensate pan 14 and vertical condensate pan 16.

When evaporator assembly 2 is integrated into a heating and/or cooling system, evaporator assembly 2 is typically mounted above or adjacent to an air handler, depending on whether evaporator assembly 2 is in a vertical or horizontal configuration. In FIG. 1A evaporator assembly 2 is oriented horizontally and would be typically mounted either to the right or to the left of the air handler. The air handler includes a blower that cycles air through evaporator assembly 2. The blower circulates air in a horizontal direction from right to left (indicated by arrow 24) through casing 4. However, the blower could alternatively circulate the air from left to right.

Coil 6, condensate pan 14, and condensate pan 16 are disposed within casing 4, which is preferably a substantially airtight space for receiving and cooling air. That is, casing 4 is preferably substantially airtight except for openings 4A and 4B (shown in FIG. 1B). Air is introduced through opening 4A and exits through opening 4B. (In the alternative arrangement, air is introduced through opening 4B and exits through opening 4A.) In the embodiment shown in FIGS. 1A and 1B, casing 4 is constructed of a single piece of sheet metal that is folded into a three-sided configuration, and may also be referred to as a "wrapper". In alternate embodiments, casing 4 may be any suitable shape and configuration and/or formed of multiple panels of material.

Coil brace 8 is connected to air seal 28 and helps support coil 6 when coil 6 is in its horizontal orientation, as shown in FIG. 1A. In a vertical orientation, casing 4 is rotated 90° in a clockwise direction. Coil 6 includes first slab 6A and second slab 6B connected by air seal 28. First and second delta plates 10A and 12A, respectively, are positioned between first and second slabs 6A and 6B, respectively. First slab 6A includes multiple turns of piping 30A with a series of thin, parallel plate fins 32A mounted on piping 30A. Similarly, second slab 6B includes multiple turns of piping 30B with a series of thin, parallel fins (not visible in FIG. 1A) mounted on piping 30B. Tube sheets 29A and 29B are attached to first slab 6A and second slab 6B, respectively, and are configured to receive piping 30A and 30B. Delta plates 10A and 12A, and air seal 28 may be attached to tube sheets 29A and 29B.

In the embodiment shown in FIG. 1A, coil 6 is a two-row coil. However, in alternate embodiments, coil 6 may include any suitable number of rows, such as three, as known in the art. Refrigerant is cycled through piping 30A and 30B, which are in fluidic communication with one another (through piping system 62, shown in FIG. 1B). As FIG. 1A illustrates, coil 6 includes input and output lines 20 and 22, respectively, which are used to recycle refrigerant to and from a compressor (which is typically located in a separate unit from evaporator assembly 2). Refrigerant input and output lines 20 and 22 extend through first cover 18. Evaporator assembly 2 also includes access cover 38 (shown in FIG. 1B) adjacent to first cover 18, and together, first cover 18 and access cover 38 fully cover the front face of evaporator assembly 2 (i.e., the face which includes first cover 18). Access cover 38 will be described in further detail in reference to FIG. 1B.

As discussed in the Background section, if the temperature of coil 6 surface is lower than the dew point of the air moving across coil 6, water vapor condenses on coil 6. If coil 6 is horizontally oriented, condensation from coil 6 drips into condensate pan 14, and drains out of condensate pan 14 through drain holes 15, which are typically located at the bottom of condensate pan 14. If coil 6 is vertically oriented, condensate pan 16 collects the condensed water from coil 6, and drains the condensation through drain holes 17, which are typically located at the bottom of condensate pan 16.

Because evaporator assembly 2 includes horizontal condensate pan 14 and vertical condensate pan 16, evaporator assembly 2 is configured for applications involving a horizontal or vertical orientation of coil 6. See the above cross-referenced applications relating to the features of a vertically-oriented evaporator assembly.

Figure 1B:
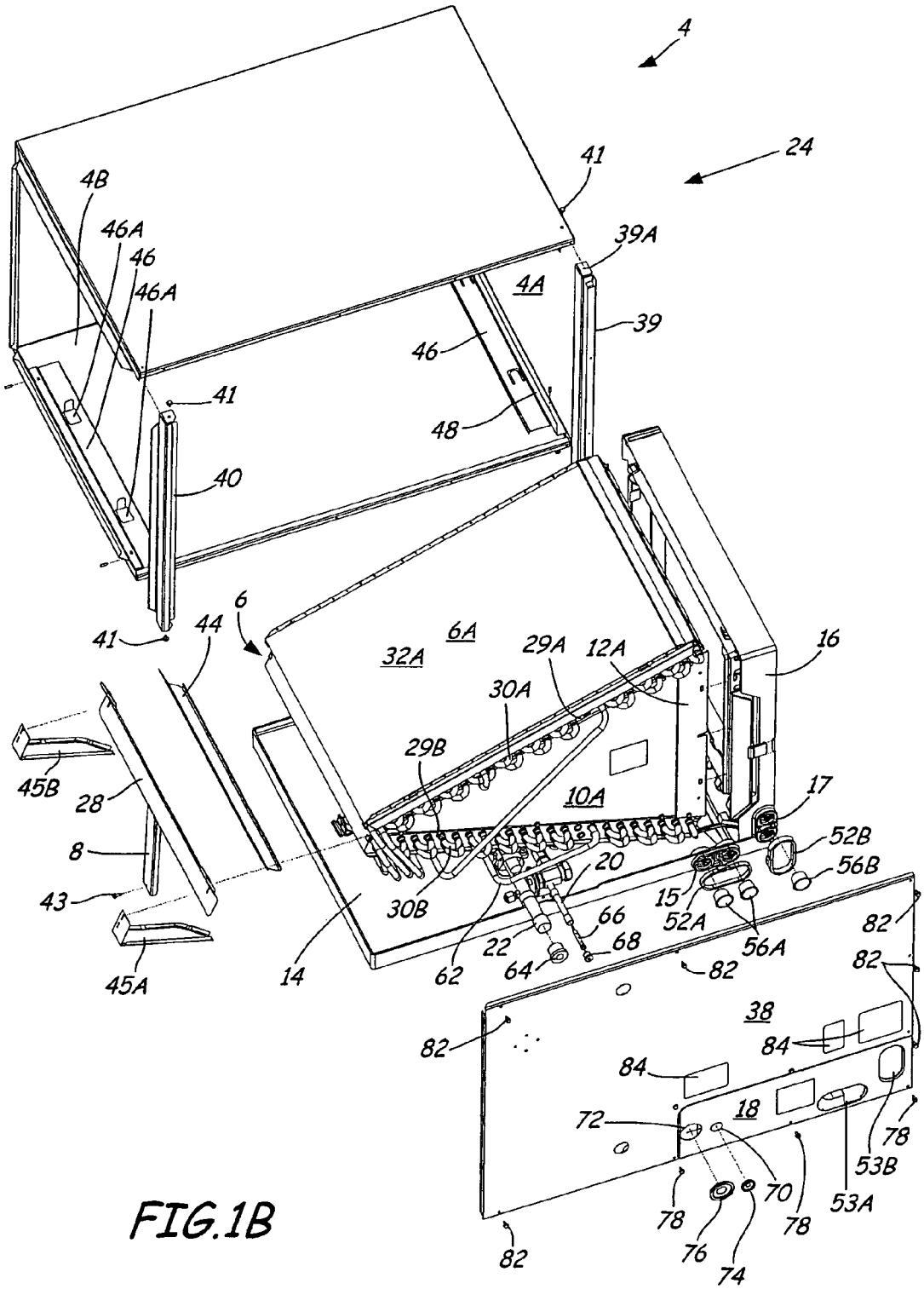
FIG. 1B is an exploded perspective view of the evaporator assembly of FIG. 1A.

FIG. 1B is an exploded perspective view of evaporator assembly 2 of FIG. 1A. Front deck 39 and upper angle 40 are each connected to casing 4 with screws 41. Another suitable method of connecting front deck 39 and upper angle 40 to casing 4 may also be used, such as welding, an adhesive or rivets. Front deck 39 and upper angle 40 provide structural integrity for casing 4 and provide a means for connecting front cover 18 and access cover 38 to casing 4. Screw 43 attaches brace 8 (and thereby, air seal 28) to condensate pan 14. Of course, other suitable means of attachment may be used in alternate embodiments. In addition to air seal 28, air splitter 44 is positioned between first slab 6A and second slab 6B of coil 6 and is attached by tabs on tube sheets 29A and 29B of coil 6.

Horizontal and vertical condensate pans 14 and 16 are typically formed of a plastic, such as polyester, but may also be formed of any material that may be casted, such as metal (e.g., aluminum). Horizontal condensate pan 14 slides into casing 4 and is secured in position by pan supports 46. Tabs 46A of pan supports 46 define a space for condensate pan 14 to slide into. Coil 6 is positioned above horizontal condensate pan 14 so that condensation flows from coil 6 into horizontal condensate pan 14. Air splitter 44 and splash guards 45A and 45B guide condensation from coil 6 into horizontal condensate pan 14. Air splitter 44 and splash guards 45A and 45B are described in further detail in reference to FIGS. 2-6B.

Condensation that accumulates in horizontal condensate pan 14 eventually drains out of horizontal condensate pan 14 through drain holes 15. Gasket 52A is positioned around drain holes 15 prior to positioning first cover 18 over drain holes 15 in order to help provide a substantially airtight seal between drain holes 15 and first cover 18. First cover 18 includes opening 53A, which corresponds to and is configured to fit over drain holes 15 and gasket 52A. The substantially airtight seal helps prevent air from escaping from casing 4, and thereby increases the efficiency of evaporator assembly 2. Caps 56A may be positioned over one or more drain holes 15, such as when evaporator assembly 2 is used in an application in which coil 6 is vertically oriented.

Vertical condensate pan 16 slides into casing 4 and is supported, at least in part, by flange 48, which is formed by protruding sheet metal on three-sides of casing 4 and top surface 39A of front deck 39. Specifically, bottom surface 16A of condensate pan 16 rests on flange 48 and top surface 39A of front deck 39. Condensate pan 16 has an open center portion; and thus, air is able to pass through openings 4A and 4B, when evaporator assembly 2 is in either a horizontal or vertical configuration.

If coil 6 were oriented vertically, condensation that accumulates in vertical condensate pan 16 eventually drains out of vertical condensate pan 16 through drain holes 17. Gasket 52B is positioned around drain holes 17 prior to positioning first cover 18 over drain holes 17 in order to help provide a substantially airtight seal between drain holes 17 and first cover 18. First cover 18 includes opening 53B, which corresponds to and is configured to fit over drain holes 17 and gasket 52B. The airtight seal helps prevent air from escaping from casing 4, and thereby increases the efficiency of evaporator assembly 2. Cap 56B may be positioned over one or more drain holes 17.

Piping system 62 fluidically connects piping 30A of first slab 6A and piping 30B of second slab 6B. Refrigerant flows through piping 30A and 30B, and is recirculated from and to a compressor through inlet and outlet tubes 20 and 22, respectively. Specifically, refrigerant is introduced into piping 30A and 30B through inlet 20 and exits piping 30A and 30B through outlet 22. As known in the art, refrigerant outlet 22 includes rubber plug 64, and refrigerant inlet 20 includes strainer 66 and rubber plug 68. Inlet 20 protrudes through opening 70 in first cover 18 and outlet 22 protrudes through opening 72 in first cover 18. By protruding through first cover 18 and out of casing 4, inlet 20 and outlet 22 may be connected to refrigerant lines that are fed from and to the compressor, respectively. Gasket 74 is positioned around inlet 20 in order to provide a substantially airtight seal around opening 70. Similarly, gasket 76 is positioned around outlet 22.

First cover 18 is attached to casing 4 with screws 78. However, in alternate embodiments, other means of attachment are used, such as welding, an adhesive or rivets. Further covering a front face of evaporator assembly 2 is access cover 38, which is abutted with first cover 18. Again, in order to help increase the efficiency of evaporator assembly 2, it is preferred that joint 81 between first cover 18 and access cover 38 is substantially airtight. A substantially airtight connection may be formed by, for example, placing a gasket at joint 81.

Access cover 38 is attached to casing 4 with screws 82. However, in alternate embodiments, any means of removably attaching access cover 38 to casing 4 are used. Access cover 38 is preferably removably attached in order to provide access to coil 6, condensate pan 16, and other components inside casing 4 for maintenance purposes. One or more labels 84, such as warning labels, may be placed on first cover 18 and/or access cover 38.

Figure 2:
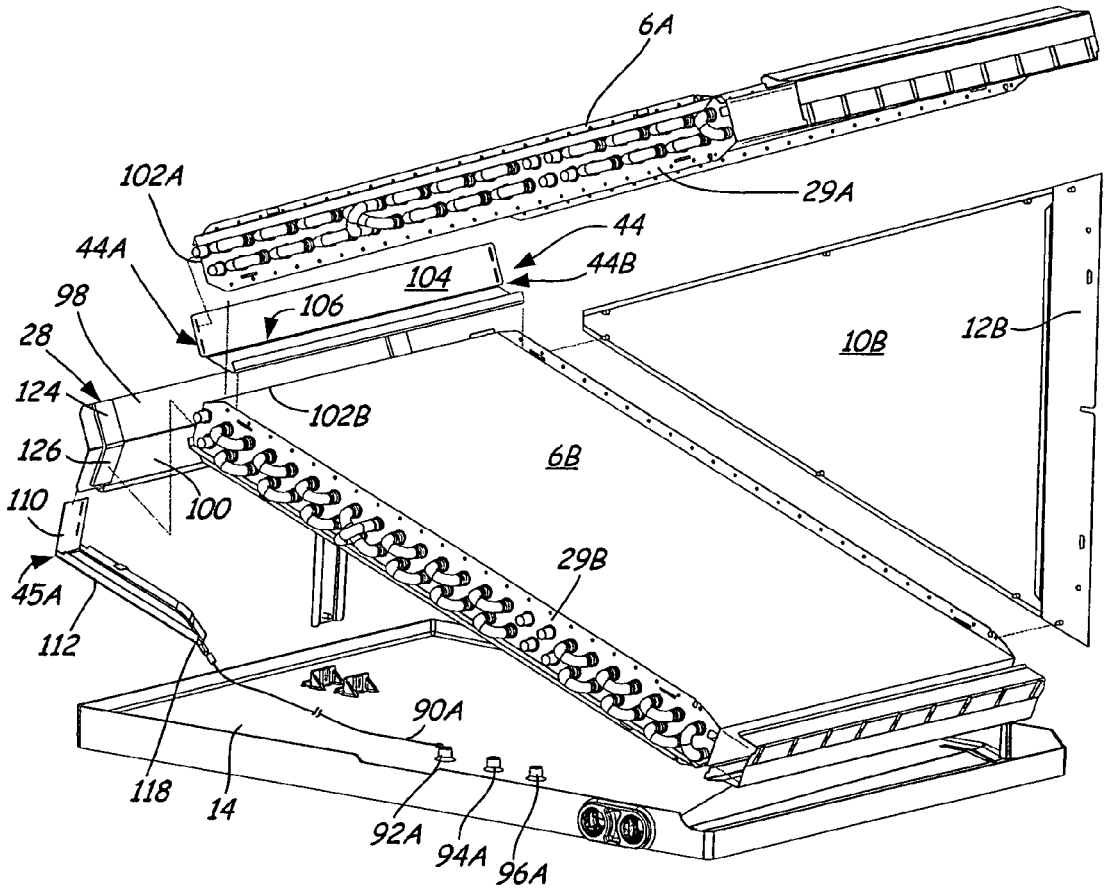
FIG. 2 is an exploded perspective view of a portion of the evaporator assembly of FIG. 1A.

FIG. 2 is an exploded perspective view of a portion of evaporator assembly 2 of FIG. 1A. The major components of evaporator assembly 2 shown in FIG. 2 are first slab 6A, tube sheet 29A, second slab 6B, tube sheet 29B, first delta plate 10B, second delta plate 12B, splitter 44, air seal 28, splash guard 45A, wire 90A and condensate pan 14.

As air is passing over coil 6, condensation forms on first slab 6A and second slab 6B. When coil 6 is oriented horizontally, it is difficult to drain the condensation to condensate pan 14 located below second slab 6B. To overcome this obstacle, splitter 44 is inserted between first slab 6A and second slab 6B, and is configured to catch the condensation that forms on first slab 6A and direct it to condensate pan 14 to prevent the condensation from being blown-off by air passing over coil 6. As explained in more detail below, once the condensation is caught in splitter 44, the condensation then flows to ends 44A and 44B, and through second coil slab 6B, onto splash guards 45A and 45B (not shown in FIG. 2). Splash guard 45A is positioned to catch the water from end 44A of splitter 44 and direct the water onto wire 90A to condensate pan 14. Wire 90A is attached to protrusion 92A formed on condensate pan 14. Similar protrusions 94A and 96A are also formed on condensate pan 14 for attachment by wire 90A.

Although splash guard 45B is not shown in FIG. 2 (see FIG. 1B), it is similar to splash guard 45A, but is instead positioned on an opposing side of second slab 6B. Splash guard 45B is configured to catch and direct condensate flowing from end 44B of splitter 44. A wire similar to wire 90A is connected to splash guard 45B and is used to direct water from splash guard 45B to condensate pan 14. A plurality of protrusions, similar to 92A, 94A and 96A but configured on an opposing side of condensate pan 14, are formed on condensate pan 14 for attachment by the wire connected to splash guard 45B.

Air seal 28 is used to position splitter 44 and splash guards 45A and 45B on coil 6. Air seal 28 also functions to prevent condensation that forms on coil 6 from being blown-off into the air stream passing either from right to left, or left to right across coil 6. Air seal 28 includes top portion 98 and bottom portion 100. Air seal 28 is configured such that top portion 98 is fixed across back face 102A of first slab 6A, and bottom portion 100 is fixed across back face 102B of second slab 6B. Top member 104 of splitter 44 is fixed between top portion 98 of air seal 28 and back face 102A of first slab 6A. As such, fold 106 of splitter 44 is positioned at junction 108 (see FIG. 6A) of first slab 6A and second slab 6B. Splitter 44 will be discussed in more detail below in reference to FIGS. 3A-3C.

Splash guard 45A includes top portion 110 and guard portion 112 and is configured to be attachable to coil 6. Guard portion 112 tapers inward towards end 118. Top portion 110 of splash guard 45A is fixed to bottom portion 100 of air seal 28, and guard portion 112 is configured to rest under second slab 6B. Splash guard 45A will be discussed in more detail below in reference to FIGS. 4A-4D and 5A-5C. Splash guard 45B (not visible in FIG. 2; see FIG. 1B) is configured similar to splash guard 45A on an opposing side of second slab 6B.

It is recognized that air seal 28, splitter 44 and splash guards 45A and 45B may be configured and attached to one another in alternative manners and still be within the scope of the present invention. In a preferred embodiment, air seal 28, splitter 44 and splash guards 45A and 45B are each formed out of sheet metal. However, it is recognized that other materials may be substituted and are within the scope of the invention.

Evaporator assembly 2 is configured such that tube sheets 29A and 29B both include tabs (not shown) that are configured to be received into slots (not shown) on top portion 98 and bottom portion 100 of air seal 28. As shown in FIG. 2, gaskets 124 and 126 may be attached to top portion 98 and bottom portion 100 of air seal 28 such that the tabs on tube sheets 29A and 29B can be inserted through gaskets 124 and 126. Gaskets 124 and 126 thus function as seals to prevent water formed on coil 6 from leaking through air seal 28. A preferred material for gaskets 124 and 126 is foam; however, it is recognized that any material suitable for sealing may be used. In addition, it is recognized that alternative sealing methods, such as caulking, may be used.

In FIG. 2, wire 90A is connected to protrusion 92A. However, condensate pan 14 is shown as having three protrusions 92A, 94A and 96A. This is because evaporator assembly 2 is configured to be used with multiple coil sizes. As the overall dimensions of the coil change, the height and angle of the second coil slab, relative to the condensate pan, will change. As a result, the distance from the splash guard to the condensate pan will correspondingly change. Therefore, multiple protrusions are formed on pan 14 to accommodate different coil sizes, without having to use wires of varying lengths. Although three protrusions are shown in FIG. 2, more or less protrusions could be formed on the condensate pan.

Figure 3A:
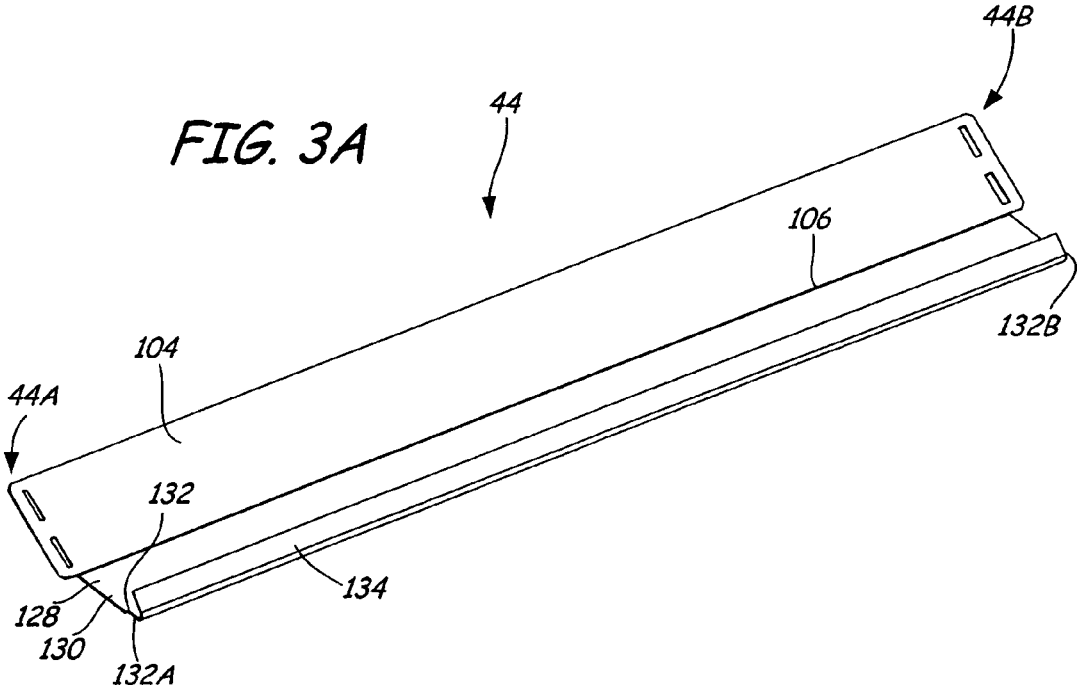
FIG. 3A is a perspective view of a splitter, which is a component of the evaporator assembly of FIG. 1A.

FIG. 3A is a perspective view of splitter 44 having ends 44A and 44B. Splitter 44 includes top member 104, fold 106, bottom member 128 including first portion 130 and notched portion 132, and lip 134. Bottom member 128 of splitter 44 is configured such that notched portion 132 includes notches 132A and 132B on ends 44A and 44B. As water from first slab 6A builds up within splitter 44, the water will be directed to ends 44A and 44B, and fall through gaps created by notches 132A and 132B. As explained above, the water then falls through second slab 6B and onto splash guards 45A and 45B.

Figure 3B:
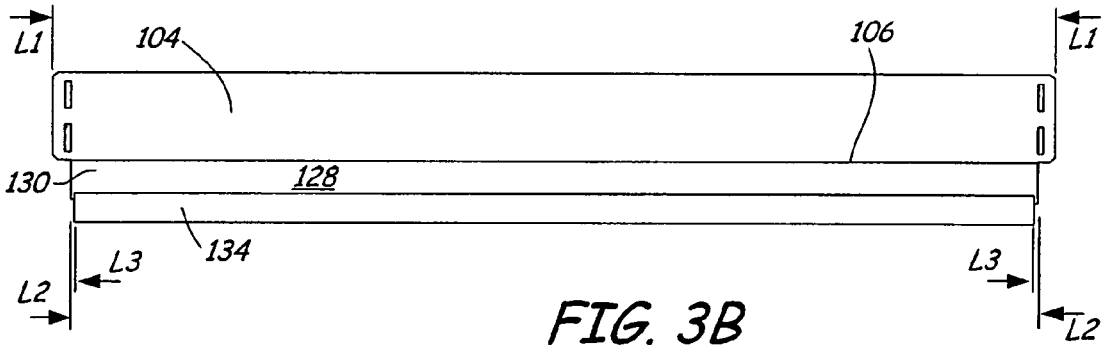
FIG. 3B is a front view of the splitter of FIG. 3A.

FIG. 3B is a front view of splitter 44 of FIG. 3A. As shown in FIG. 3B, top member 104 has length L1, first portion 130 of bottom member 128 has length L2 and notched portion 132 and lip 134 both have length L3. L1 is greater than L2 in order to fix top member 104 between first slab 6A and air seal 28, and also to provide some clearance such that splitter 44 can be placed inside coil 6 between delta plates 10A (see FIG. 1A) and 10B. Length L3 is less than L2 because of notches 132A and 132B. The dimension of the gap created by notch 132A is one half of the difference between L2 and L3. The dimension of the gap created by notch 132B is essentially the same as the gap created by notch 132A. In a preferred embodiment, notches 132A and 132B each create a gap of approximately 1.5 mm.

Figure 3C:
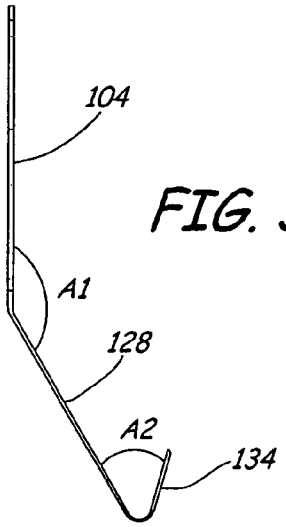
FIG. 3C is a side view of the splitter of FIG. 3A.

FIG. 3C is a side view of splitter 44 of FIG. 3A. FIG. 3C shows angle A1 between top member 104 and bottom member 128, as well as angle A2 between bottom member 128 and lip 134. In the embodiment of splitter 44 shown in FIGS. 3A-3C, angle A1 is approximately 150 degrees and angle A2 is less than 90 degrees. Splitter 44 is configured such that top member 104 is placed behind first slab 6A and bottom member 128 is adjacent and rests on second slab 6B. Bottom member 128 and lip 134 are configured such that water directed down first slab 6A and onto splitter 44 is initially caught within splitter 44.

Figure 4A:
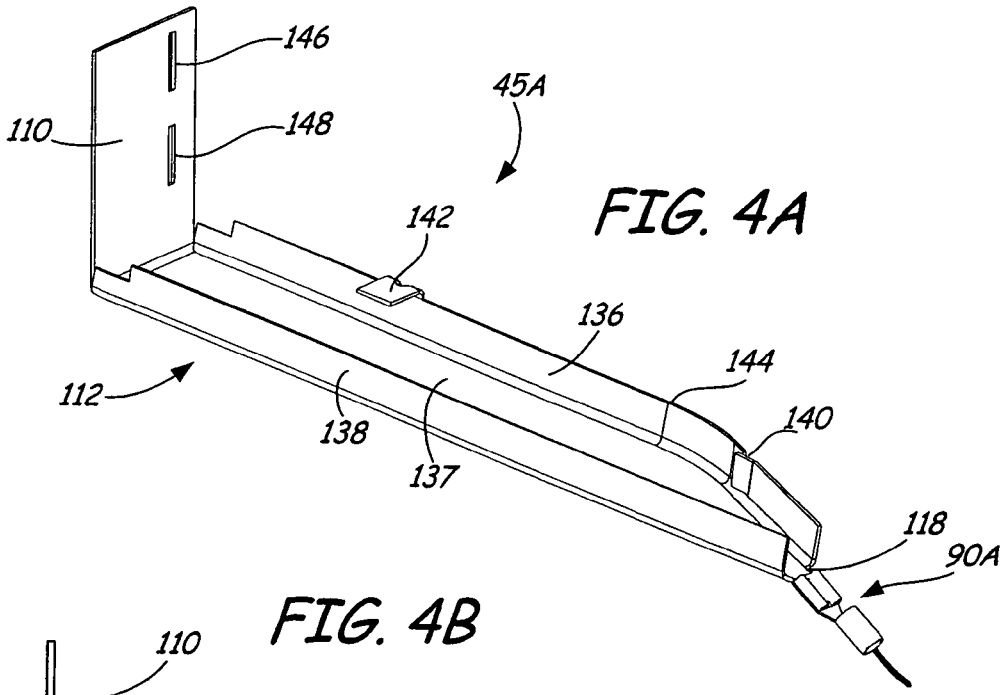
FIG. 4A is a perspective view of a splash guard, which is a component of the evaporator assembly of FIG. 1A.

FIG. 4A is a perspective view of splash guard 45A including top portion 110 and guard portion 112. Guard portion 112 includes first side wall 136, bottom portion 137, second side wall 138, and extension 139 (not shown; see FIGS. 4B-4D) extending from end 118 for attachment by wire 90A. Bottom portion 137 is connected to top portion 110. In the embodiment of splash guard 45A shown in FIG. 4A, first side wall 136 includes slit 140 and tab 142. First side wall 136 begins to taper inward toward second side wall 138 at the location marked 144. Slit 140 is configured such that guard portion 112 fits onto tube sheet 29B of second slab 6B, as described in more detail below with reference to FIGS. 5A-5C. Tab 142 is configured to be received into a notch on tube sheet 29B, as also explained in more detail below. Top portion 110 includes slots 146 and 148.

Figure 4B:
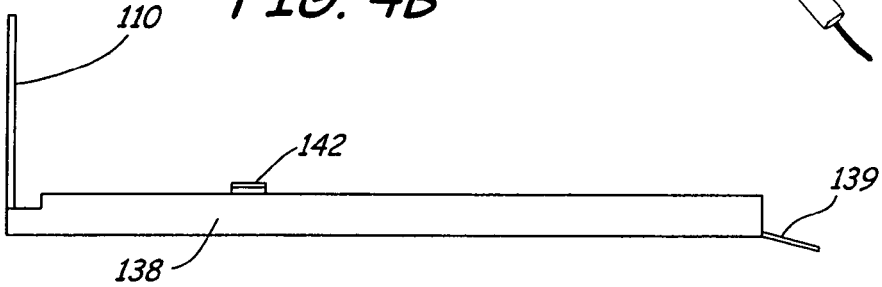
FIG. 4B is a side view of the splash guard of FIG. 4A.

FIG. 4B is a side view of splash guard 45A including some of the components described above under FIG. 4A.

Figure 4C:
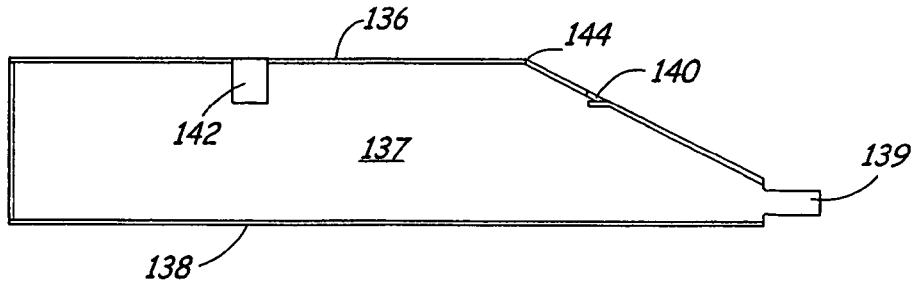
FIG. 4C is a top plan view of the splash guard of FIG. 4A.

FIG. 4C is a top plan view of splash guard 45A showing first side wall 136, bottom portion 137 and second side wall 138. As shown in FIG. 4C, tab 142 extends inward from first side wall 136 toward second side wall 138. First side wall 136 begins to taper inward at 144 and second side wall 138 is substantially straight. Slit 140 formed on first side wall 136 is also visible.

Figure 4D:
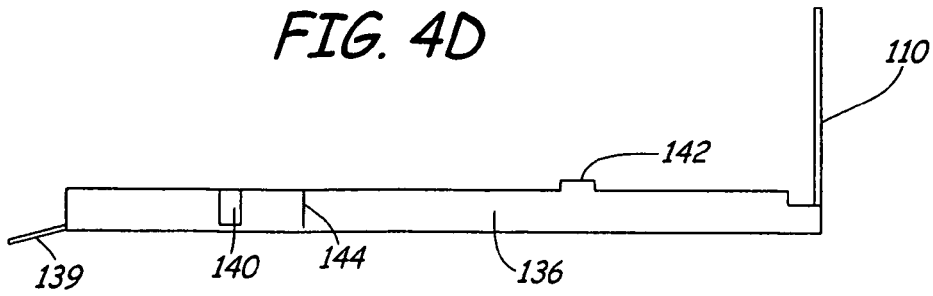
FIG. 4D is a side view of the splash guard of FIG. 4B rotated 180 degrees.

FIG. 4D is a side view of splash guard 45A rotated 180 degrees and further illustrates the components described above.

Figure 5A:
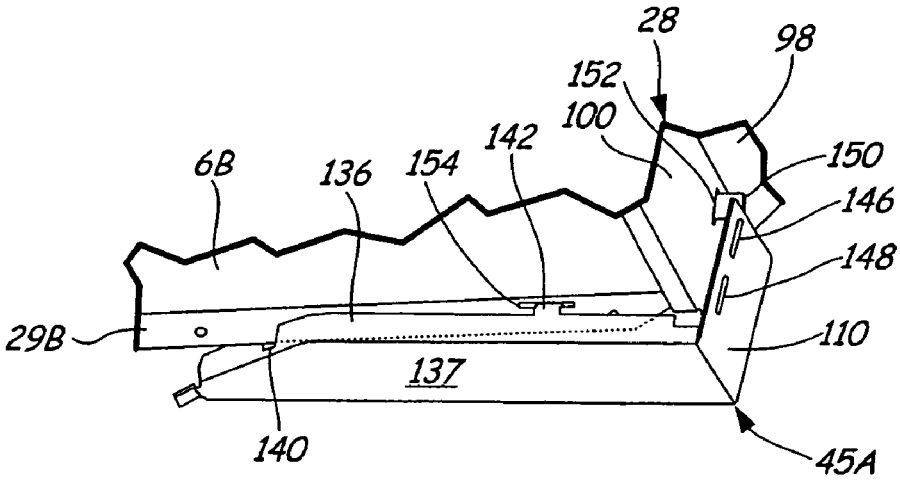
FIG. 5A is a bottom perspective view of an underside of the second coil slab and the splash guard of FIG. 2.
Figure 5B:
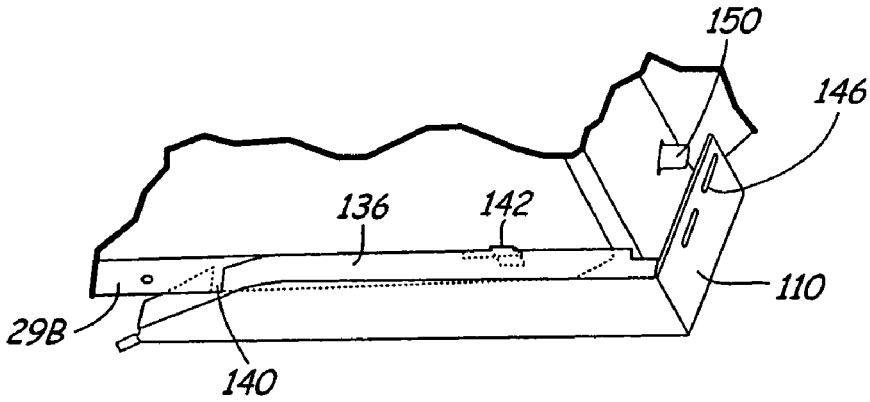
FIGS. 5B and 5C are similar to FIG. 5A and illustrate the splash guard being attached to the second coil slab.
Figure 5C:
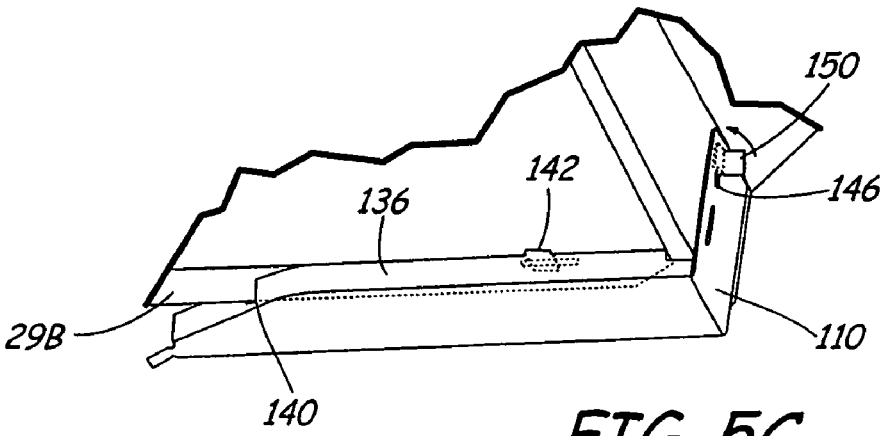

FIGS. 5A-5C are bottom perspective views of an underside of second slab 6B and splash guard 45A of FIG. 2 to illustrate how splash guard 45A is attached to coil 6. The major components visible in FIG. 5A are second slab 6B, tube sheet 29B, air seal 28 and splash guard 45A. As explained above, tube sheet 29B includes a tab that is configured to be received into a slot on bottom portion 100 of air seal 28. Tab 150 of tube sheet 29B is received through slot 152 of bottom portion 100 of air seal 28.

In a preferred embodiment of splash guard 45A shown in FIGS. 4A-4D, splash guard 45A is configured to be attachable to coil 6 without requiring any fasteners. As shown in FIG. 5A, first side wall 136 is attached to tube sheet 29B by engaging slit 140 with a bottom edge of tube sheet 29B. Tab 142 on first side wall 136 is then received through notch 154 on tube sheet 29B. As such, tab 142 faces away from second slab 6B and toward casing 4, and second wall 138 (not shown in FIG. 5A) is positioned outside second slab 6B.

As shown in FIG. 5B, splash guard 45A is then rotated such that slot 146 or slot 148 on top portion 110 is aligned with tab 150 of tube sheet 29B. In FIG. 5B, slot 146 is aligned with tab 150. Splash guard 45A is configured with two slots 146 and 148 on top portion 110 such that splash guard 45A is interchangeable between a two-row coil and a three-row coil. After tab 150 is received through slot 146, as shown in FIG. 5C, the last step consists of bending tab 150 down onto top portion 110 of splash guard 45A to secure splash guard 45A to coil 6.

Splash guard 45B, shown in FIG. 1B, is similar to splash guard 45A and is attachable on an opposing side of second slab 6B. Splash guard 45B is attachable to coil 6 in much the same way as described above under FIGS. 5A-5C; however, a tab on splash guard 45B, similar to tab 142 of splash guard 45A, is inserted through a slot on an opposing tube sheet such that the tab faces toward the center of coil 6 and away from casing 4. As such, the second wall of splash guard 45B, similar to second wall 138 of splash guard 45A, is positioned underneath second slab 6B, instead of on the outside of second slab 6B.

It is beneficial to use the same splash guard for opposing sides of the bottom coil slab to avoid the extra costs associated with having to manufacture two oppositely configured splash guards. However, in an alternative embodiment, splash guard 45B is a mirror image of splash guard 45A and is configured to coil 6 in the same manner as described above under FIGS. 5A-5C.

Figure 6B:
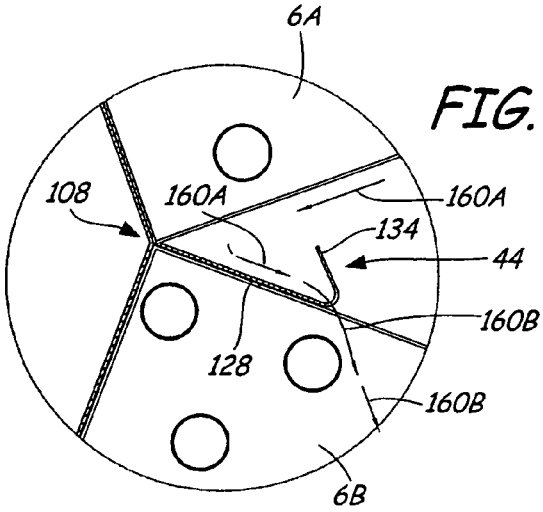
FIG. 6B is an enlarged view of a portion of FIG. 6A.
Figure 6A:
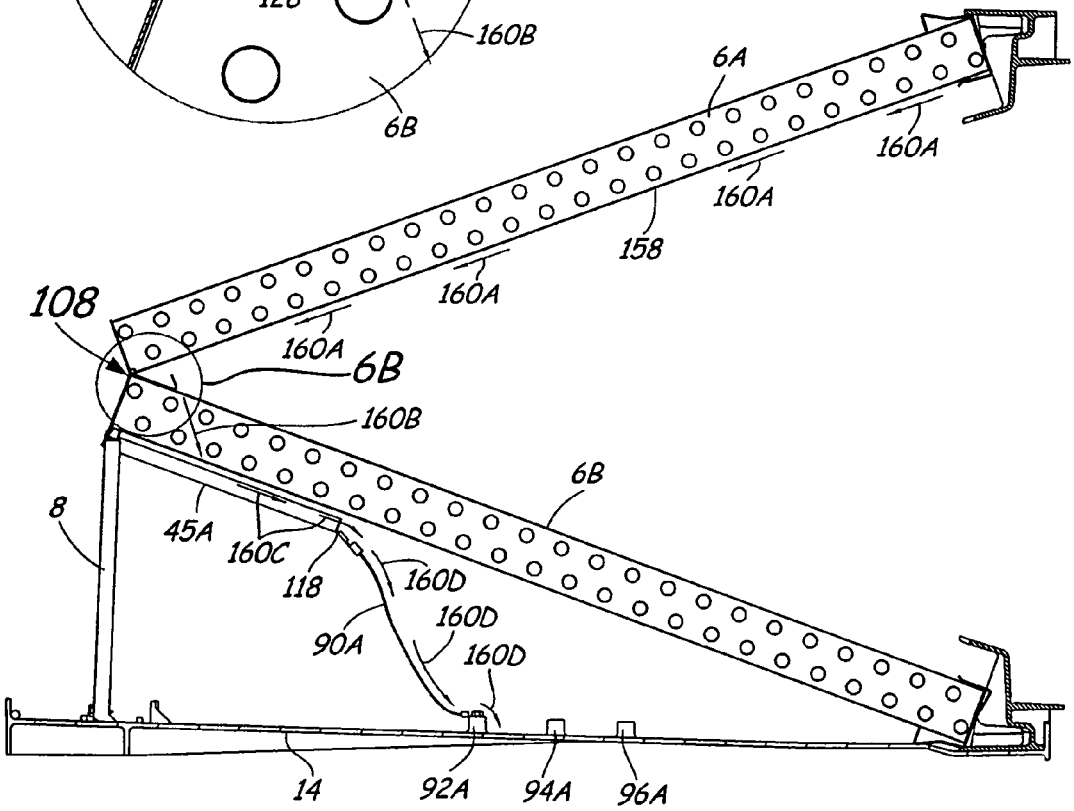
FIG. 6A is a cross-sectional view of the portion of the evaporator assembly shown in FIG. 2.

FIG. 6A is a cross-sectional view of the portion of the evaporator assembly shown in FIG. 2, and is used to illustrate in greater detail how condensation is drained into condensate pan 14. When condensation forms on first slab 6A, the condensation falls through fins 32A on a top surface of first slab 6A and around piping 30A. The condensation then runs down a similar series of fins on underside 158 of first slab 6A until it reaches junction 108 of coil 6. (This path of the condensation is indicated by arrows 160A in FIG. 6A.) Splitter 44 is positioned within junction 108 and configured such that when the condensation reaches junction 108, splitter 44 catches the condensation.

When air is passing over coil 6, there is a constant draining of water into splitter 44. As the water or condensation builds up within splitter 44, subsequent condensation that is drained into splitter 44 forces the water to flow away from the center of splitter 44 and towards either end 44A or 44B (see FIG. 2). When the condensation reaches end 44A or 44B, the condensation falls through second slab 6B and onto splash guards 45A and 45B (not shown in FIG. 6A) that are positioned below second slab 6B and fixed to air seal 28. (This path of the condensation is indicated by arrows 160B in FIGS. 6A and 6B.) Like first slab 6A, second slab 6B is configured such that the condensation falls through fins on a top surface of second slab 6B, around piping 30B, and then through a similar set of fins on an underside of second slab 6B. Although not required, there may be a gap between the fins on the top surface of the second slab and the tube sheet, and similarly a gap between the tube sheet and the fins on the underside of the second slab. As such, the condensation is able to flow through this gap and onto splash guard 45A.

Because splash guard 45A and second slab 6B are configured at an angle, once the condensation drops onto splash guard 45A, the condensation is directed down splash guard 45A to end 118 of guard 45A, as indicated by arrows 160C. Wire 90A is connected at one end to end 118 of guard 45A and at another end to protrusion 92A of condensate pan 14. Wire 90A is used to prevent or minimize splashing of water as the condensate travels from end 118 of splash guard 45A and into condensate pan 14, as indicated by arrows 160D.

Similar to FIG. 2, FIG. 6A does not show splash guard 45B. However, as explained above, splash guard 45B functions essentially the same as splash guard 45A, but is positioned at an opposing end of second slab 6B. Condensation that reaches end 44B of splitter 44 falls through second slab 6B and onto splash guard 45B. A wire similar to wire 90A is attached to an end of splash guard 45B and is configured to prevent or minimize splashing of water as the condensate travels from splash guard 45B into condensate pan 14. A plurality of protrusions similar to 92A, 94A and 96A are formed on condensate pan 14 for attachment by the wire attached at its other end to splash guard 45B.

FIG. 6B is an enlarged view of a portion of FIG. 6A showing splitter 44 positioned between first slab 6A and second slab 6B at junction 108 of coil 6. Bottom member 128 of splitter 44 rests on a top inclined surface of bottom slab 6B and as such, splitter 44 is angled similar to bottom slab 6B. Thus, when the condensation is caught within splitter 44, the condensation flows down bottom member 128 and toward lip 134. Again, this path of the condensation is indicated by arrows 160A. Although not visible in FIG. 6B, the condensation that is caught in splitter 44 will be directed to and fall through notch 132A on end 44A of splitter 44 and through second slab 6B. This path is indicated by arrows 160B as shown in FIG. 6B.

The terminology used herein is for the purpose of description, not limitation. Specific structural and functional details disclosed herein are not to be interpreted as limiting, but merely as bases for teaching one skilled in the art to variously employ the present invention. Although the present invention has been described with reference to preferred embodiments, workers skilled in the art will recognize that changes may be made in form and detail without departing from the spirit and scope of the invention.

The invention claimed is:

1. A system for disposing of a condensate formed on an evaporator coil, the system comprising:

a horizontally oriented multi-poise evaporator coil, the evaporator coil comprising a top coil slab and a bottom coil slab;

a condensate pan located under the bottom coil slab;

a splitter having a top member positioned on the back face of the top coil slab and a bottom member positioned on an inclined top surface of the bottom coil slab for catching the condensate from an underside of the top coil slab and directing the condensate to a first end or a second end of the splitter and then through the bottom coil slab;

an air seal having a top member attached to the back face of the top coil slab and sandwiching the top member of the splitter between the top member of the air seal and the back face of the top coil slab and a bottom member of the air seal attached to a back face of the bottom coil slab;

a first splash guard positioned on a first side of the bottom coil slab;

a second splash guard positioned on a second side of the bottom coil slab;

a first wire having a first end coupled to the first splash guard and a second end coupled to the condensate pan; and a second wire having a first end coupled to the second splash guard and a second end coupled to the condensate pan.

* * * * *